US009512625B2

(12) United States Patent
Taylor

(10) Patent No.: US 9,512,625 B2
(45) Date of Patent: Dec. 6, 2016

(54) GROUT REMOVAL AND MASONRY TRENCHING TOOL

(76) Inventor: Ian Ronald Taylor, Walkerville (AU)

( * ) Notice: Subject to any disclaimer, the term of this patent is extended or adjusted under 35 U.S.C. 154(b) by 248 days.

(21) Appl. No.: 13/990,885

(22) PCT Filed: Dec. 2, 2011

(86) PCT No.: PCT/AU2011/001564

§ 371 (c)(1),
(2), (4) Date: Aug. 13, 2013

(87) PCT Pub. No.: WO2012/071623

PCT Pub. Date: Jun. 7, 2012

(65) Prior Publication Data

US 2014/0068950 A1 Mar. 13, 2014

(30) Foreign Application Priority Data

Dec. 1, 2010 (AU) ..... 2010905283

(51) Int. Cl.
*E04F 21/00* (2006.01)
*A47L 13/08* (2006.01)
(Continued)

(52) U.S. Cl.
CPC ..... *E04F 21/0084* (2013.01); *A47L 13/08* (2013.01); *B28D 1/183* (2013.01); *B28D 1/228* (2013.01); *B44D 3/162* (2013.01)

(58) Field of Classification Search
CPC ... E04F 21/0084; B28D 1/228; B28D 1/183; B26B 27/005; B26B 29/00; B26B 29/04; A47L 13/08; B44D 3/162; B44D 3/164; B27G 17/04
USPC ..... 30/1, 2, 481, 484, 487, 168–172, 278, 30/280
See application file for complete search history.

(56) References Cited

U.S. PATENT DOCUMENTS 148,136 A * 3/1874 Parmele ..... B23D 51/01 30/520
951,135 A * 3/1910 Kyte ..... B44D 3/162 30/172

(Continued)

FOREIGN PATENT DOCUMENTS

DE 20001290 3/2001
DE 102004055691 5/2006

(Continued)

OTHER PUBLICATIONS

Extended Search Report for European Patent Application No. 11845330.7, dated Jun. 19, 2015, 8 pages.

(Continued)

*Primary Examiner* — Sean Michalski
(74) *Attorney, Agent, or Firm* — Sheridan Ross PC

(57) ABSTRACT

A tool for dislodging grout from a joint between two adjacent planar surfaces, or for removing a strip of material from a masonry surface including, a generally elongate body having a lower portion dimensioned to fit at least partially within a channel created by a first cutting tip of a first blade or edge, the first cutting tip forwardly facing for impinging upon and dislodging material, a guide forward of said first blade or edge for controlling the depth to which said first blade or edge penetrates said grout or said masonry surface, and a front portion of said tool being curved upwardly, said front portion including a second blade or edge having a leading secondary cutting tip, whereby the rear of the tool may be pivoted upward about the leading edge of said tool to utilise said secondary cutting tip to dislodge said material without being inhibited or obstructed by said guide.

15 Claims, 17 Drawing Sheets

(51) Int. Cl.

| | |
|---|---|
| ***B28D 1/18*** | (2006.01) |
| ***B28D 1/22*** | (2006.01) |
| *B44D 3/16* | (2006.01) |

(56) References Cited

U.S. PATENT DOCUMENTS 1,171,241 A * 2/1916 Potter ..... A22C 25/025 30/144
1,438,645 A * 12/1922 Hill ..... B23D 49/11 30/517
1,445,021 A * 2/1923 Johnson ..... E04F 21/165 15/105.5
1,452,697 A * 4/1923 Mullen ..... A01B 43/00 171/101
1,872,939 A * 8/1932 Haddican ..... B23D 49/11 29/270
2,236,093 A * 3/1941 Friend ..... B44D 3/162 15/236.06
2,339,843 A * 1/1944 Dillon ..... A22B 5/205 30/166.3
2,496,280 A * 2/1950 Endicott ..... E04F 21/0084 30/172
2,546,577 A * 3/1951 Young ..... B27G 17/04 15/236.08
2,969,053 A * 1/1961 Wentzel ..... B28D 1/128 125/22
4,064,588 A * 12/1977 Cooper ..... E04F 21/0084 15/235.3
4,155,142 A * 5/1979 Demetriadis ..... E04F 21/165 15/235.3
4,156,966 A * 6/1979 Eubank ..... B23D 49/11 30/166.3
4,202,093 A * 5/1980 Wallerstein ..... A47L 13/08 15/236.01
4,338,718 A * 7/1982 Olkkola ..... E04F 21/165 30/171
D268,639 S * 4/1983 Johannsen ..... B28D 1/128 D7/650
4,481,689 A * 11/1984 Westmoreland ..... B44D 3/164 15/236.01
4,759,092 A * 7/1988 Duddy ..... B44D 3/162 15/236.08
4,768,254 A * 9/1988 Bell ..... B44D 3/164 15/143.1
4,821,418 A * 4/1989 Windhager ..... A47L 13/08 30/329
4,856,135 A * 8/1989 Stewart ..... E04F 21/165 15/105.5
4,879,780 A * 11/1989 Prebeck ..... E04F 21/165 15/105.5
4,920,647 A * 5/1990 Riley ..... E04F 21/0084 15/236.1
5,440,777 A * 8/1995 Olivieri ..... B44D 3/164 15/236.01
5,440,811 A * 8/1995 Challis ..... B44D 3/164 30/169
5,497,525 A * 3/1996 Woodgate ..... A47L 13/02 15/104.8
5,687,484 A * 11/1997 Hahn ..... B44B 11/02 30/353
5,692,308 A * 12/1997 Di Libero ..... B26B 9/02 30/308
5,697,835 A * 12/1997 Nitz ..... B23D 61/006 125/15
5,809,604 A * 9/1998 Olstyn ..... B25G 3/06 15/111
6,023,811 A * 2/2000 Ciarrocchi ..... A47L 13/022 15/236.01
6,073,298 A * 6/2000 O'Brien ..... A46B 5/0091 15/144.1
6,134,743 A * 10/2000 Schmidt ..... A47L 13/022 15/111
6,182,364 B1 * 2/2001 Reyburn ..... B26B 5/00 30/2
6,237,181 B1 * 5/2001 Onuffer ..... A47L 13/08 15/142
6,283,843 B1 * 9/2001 Romagnoli ..... B23D 49/11 451/523
6,314,644 B1 * 11/2001 Raeker ..... B26B 27/005 30/2
6,357,122 B2 * 3/2002 Bachta ..... B23D 49/11 30/144
6,421,860 B1 * 7/2002 Abbott ..... B25F 1/00 15/105
6,427,274 B1 * 8/2002 Abbott ..... B44D 3/006 15/105
6,497,046 B1 * 12/2002 Bardeen ..... B23D 51/01 30/342
6,719,504 B2 * 4/2004 Downey ..... B28D 1/00 144/136.95
D547,633 S * 7/2007 Troxell ..... B25D 17/005 D8/97
D584,116 S * 1/2009 Jackson ..... D7/696
7,472,484 B2 * 1/2009 Smilanich ..... B25F 1/00 30/308.1
7,587,777 B2 * 9/2009 Ogburn ..... A47L 13/022 15/236.08
8,615,838 B1 * 12/2013 Lu ..... A47L 13/12 15/111
8,683,641 B2 * 4/2014 Weinberger ..... A47J 43/288 15/104.001
8,727,838 B2 * 5/2014 Leung ..... B24B 23/005 451/344
8,875,406 B2 * 11/2014 Collard ..... B26B 5/00 30/280
D722,412 S * 2/2015 Tsai ..... B26B 5/00 D32/46
2002/0092099 A1 * 7/2002 Burns ..... E04G 23/0203 7/170
2003/0145472 A1 * 8/2003 Swift ..... B23D 49/11 30/374
2003/0192142 A1 * 10/2003 Veith ..... E04F 21/0084 15/235.4
2005/0002747 A1 * 1/2005 Adkins ..... B23C 1/20 409/180
2006/0185317 A1 * 8/2006 Rice ..... E04F 21/0084 52/742.16
2008/0104789 A1 * 5/2008 Meier ..... B23P 19/047 15/236.01
2009/0133890 A1 * 5/2009 Duggan ..... B25D 17/005 173/132
2009/0293414 A1 * 12/2009 Keohan ..... E04F 21/165 52/742.16
2009/0294489 A1 * 12/2009 Keohan ..... E04F 21/165 222/611.2
2010/0162573 A1 * 7/2010 Liao ..... E04F 21/165 30/169
2012/0180226 A1 * 7/2012 Pedersen ..... B25D 1/00 7/144
2013/0312271 A1 * 11/2013 Floyd ..... E04F 21/0084 30/294
2014/0068950 A1 * 3/2014 Taylor ..... B28D 1/183 30/172
2014/0224093 A1 * 8/2014 Myers ..... B27G 17/04 83/861

FOREIGN PATENT DOCUMENTS

FR 2568815 A 2/1986
GB 409820 5/1934
GB 2207380 A 2/1989

OTHER PUBLICATIONS

International Search Report prepared by the Australian Patent Office on Jan. 19, 2012, for International Application No. PCT/AU2011/001564.

* cited by examiner

GROUT REMOVAL AND MASONRY TRENCHING TOOL

CROSS REFERENCE TO RELATED APPLICATIONS

This application is a national stage application under 35 U.S.C. 371 and claims the benefit of PCT Application Ser. No. PCT/AU2011/001564 having an international filing date of 2 Dec. 2011, which designated the United States, and which PCT application claimed the benefit of Australian Application No. 2010905283 filed 1 Dec. 2010, the disclosure of which is incorporated herein by reference.

FIELD OF THE INVENTION

The present invention relates to a grout removing and masonry trenching or chasing device, and in one aspect relates to a tool including first and second cutting blades or edge and a depth control guide associated with the first blade or edge.

BACKGROUND OF THE INVENTION

Grout is a construction material used to seal joints between wall tiles and floor tiles. Grout is typically composed of a mixture of water, cement, sand, and a colour tint. The grout is applied to the joints as a viscous material and hardens over a short period of time.

One of the problems with this type of construction material is that it is porous, which means it can discolour and break down over time. More recently grout sealers have been applied to the dried grout. The grout sealers are water-based or solvent-based sealant that resists water, oil and acid-based contaminants penetrating the grout.

In situations where sealers have not been used or the sealer has degraded over time, the grout can become discoloured and be susceptible to break down by the action of mould or moisture. In these situations a grout saw or grout scraper can be used to remove the grout. The scraper can be a hand held manual tool or a power tool that typically includes a blade composed of tungsten carbide for the removal of old and discoloured grout. The blade may also have hardened chips or granules welded or fused along one edge of the blade.

The blade may be fixed to a handle wherein the user moves the blade back and forth along the grouted joint applying pressure to impinge upon the grout to thereby dislodge the grout. This process requires significant effort and the user must concentrate to ensure that the blade or edge does not jump out from within the joint therefore scratching the tile surface.

The blade can also be mounted on a power tool to reduce the time requirement and prevent user fatigue.

It is also difficult to use the currently available tools to remove grout from joints in confined locations. Furthermore the currently available tools do not control the depth to which the tool can penetrate the surface thereby the operator must pay particular attention to the depth the tool has penetrated the surface.

During renovations or at the time of building, grooves or trenches are created in masonry walls to install pipes or electrical cables. Trenches may also be created during the process of chasing pipes into masonry walls. Currently an angle grinder with a masonry blade is used to cut two grooves down or along the wall, a hammer and chisel or an electric impact chisel is then used to remove the plaster or masonry between the two grooves. Using a hammer and chisel labour is intensive and risks injury and/or unsatisfactory out-comes due to operator fatigue and loss of concentration. Both methods require the operator to control the depth potentially damaging the integrity of the masonry construction.

It should be appreciated that any discussion of the prior art throughout the specification is included solely for the purpose of providing a context for the present invention and should in no way be considered as an admission that such prior art was widely known or formed part of the common general knowledge in the field as it existed before the priority date of the application.

SUMMARY OF THE INVENTION

It could be broadly understood that the invention resides in a tool for dislodging grout from a joint between two adjacent planar surfaces, or for removing a strip of material from a masonry surface, including a first incising member, a guide for controlling the depth to which said first incising member penetrates said joint or said masonry surface, and a second incising member for dislodging said grout or remove said strip of material without impediment by said guide.

In accordance with another aspect of the invention, but not necessarily the broadest aspect, there is proposed a tool for dislodging grout from a joint between two adjacent planar surfaces, or for removing a strip of material from a masonry surface including, a generally elongate body having a lower portion dimensioned to fit at least partially within a channel created by a first cutting tip of a first blade or edge, the first cutting tip forwardly facing for impinging upon and dislodging material, a guide forward of said first blade or edge for controlling the depth to which said first blade or edge penetrates said grout or said masonry surface, and a front portion of said tool being curved upwardly, said front portion including a second blade or edge having a leading secondary cutting tip or edge, whereby the rear of the tool may be pivoted upward about the leading edge of said tool to utilise said secondary cutting tip or edge to dislodge said material without being inhibited or obstructed by said guide.

The underside of the first blade or edge rearward of the first cutting tip is relieved at an angle upward from the grout or masonry surface to allow the first cutting tip to penetrate the surface. The area of the main body of the tool behind the first cutting tip is also relieved, so as to allow the tip to penetrate the surface when commencing, once the tip has penetrated the surface the guide controls the depth of the first cutting tip.

Preferably the body includes an upwardly extending cavity between the first blade or edge and the guide. The cavity is located forward of the cutting edge and extends above the first blade or edge to provide space into which the dislodged material can move. As the material is in the process of being removed it will tend to become raised forward of the cutting edge. The cavity will therefore accommodate any upward movement of the material, without operation of the guide being affected.

In this way the first blade or edge can be used to remove the grout in open areas away from the corners of the room. The guide that is positioned forwards of the first blade or edge controls the depth to which the forwardly facing cutting edge penetrates the grout. It is envisaged that the guide will be predominantly a depth control means.

When a user wants to remove grout from a confined space or in areas close to the perpendicular junction between two surfaces such as where a wall meets the floor the tool can be pivoted up, rotated or otherwise moved so the second blade or edge can be used without being obstructed by the depth guide. As the reader will appreciate in this second orientation the tip of the cutting edge of said second blade or edge projects forward of the body and therefore the user can remove material from the joint without being hindered by the guide.

The tool provides a first blade or edge with a forward guide that can be used to remove material from joints where the surface is generally flat and the tool can be pivoted up so that the second blade or edge can be used where there are obstacles or where there is a junction between surfaces.

The guide may be positioned at the leading edge of the body when the first blade or edge is being used to remove the grout. In one form the body is generally planar in the vertical between the leading and trailing edges and includes a generally flat longitudinally extending lower horizontal edge for engagement with a longitudinal portion of the joint. The generally planar body and guide may be of unitary construction wherein the guide includes a longitudinally extending lower horizontal edge for engagement with a longitudinal portion of the joint forward of said first blade or edge.

The lower horizontal edge of the guide may act to direct the first blade or edge to inhibit it from disengaging from within the joint. The guide may also act as a depth gauge to inhibit the first blade or edge from penetrating into the joint to a point where it impinges upon the underlying surface of the wall or floor. Typically in the case of grout removal, it will not be necessary to remove grout below the thickness of the tile as the user will either re-grout or remove damaged tiles. However it will be appreciated that contact with the underlying surface could damage or hasten wear of the blade or edge if the surface is hard, such as concrete. Alternatively, if the underlying surface is cladding, such as blue board, the integrity of the surface may be damaged.

In the case of masonry trenching it is desired to limit the depth of the trench so as to maintain the structural integrity of said masonry.

The depth to which the first blade or edge penetrates the joint may be determined by the distance between the lower horizontal edge of the guide and a lowermost tip of the cutting edge of the first blade or edge.

The lower edge of the guide may be generally flat or in another form may include a longitudinal portion for engagement within the joint. The guide will be dimensioned to fit into the groove created by a first pass of the cutting blade or edge.

The leading edge of the guide may include a hardened portion. The hardened portion may be constructed of tungsten carbide and may be removable or integral with the guide.

The first blade or edge and second blade or edge may be integral with the body such that when the cutting edges are worn the tool is discarded. The blades may be constructed from tungsten carbide or they may be integral with the tool and constructed from forged steel or the like.

In an alternate form the first and second blades may be reversibly attached to the body. In this way when the blades are worn or damaged they can be replaced, the second blade would likely be replaced with less frequency than the first blade as it is only used in certain circumstances and therefore the blades could be replaced separately.

The grout removal tool will generally be mounted to a power tool, such as an impact tool or reciprocating tool, or the generally elongate body and blades may be integral with a specialised power tool.

In accordance with another aspect of the invention there is provided a method of removing grout from a joint between tiles or material from a masonry surface, including the steps of:

positioning a tool against a joint between at least two adjacent tiles, or on a masonry surface, said tool having a first blade or edge with a forwardly facing cutting edge and a guide forward of said first blade or edge, applying a force wherein the first blade or edge impinging upon and dislodging said grout from with the joint or material from said masonry surface, wherein the guide controls the depth to which said first blade or edge penetrates, pivoting, rotating or otherwise moving the tool to access a second blade or edge that can be utilised to dislodge said grout or said material wherein during use the second blade or edge is uninhibited by said guide.

BRIEF DESCRIPTION OF THE DRAWINGS

The accompanying drawings, which are incorporated in and constitute a part of this specification, illustrate implementations of the invention and, together with the description and claims, serve to explain the advantages and principles of the invention. In the drawings.

DETAILED DESCRIPTION OF THE ILLUSTRATED AND EXEMPLIFIED EMBODIMENTS

Figure 1:
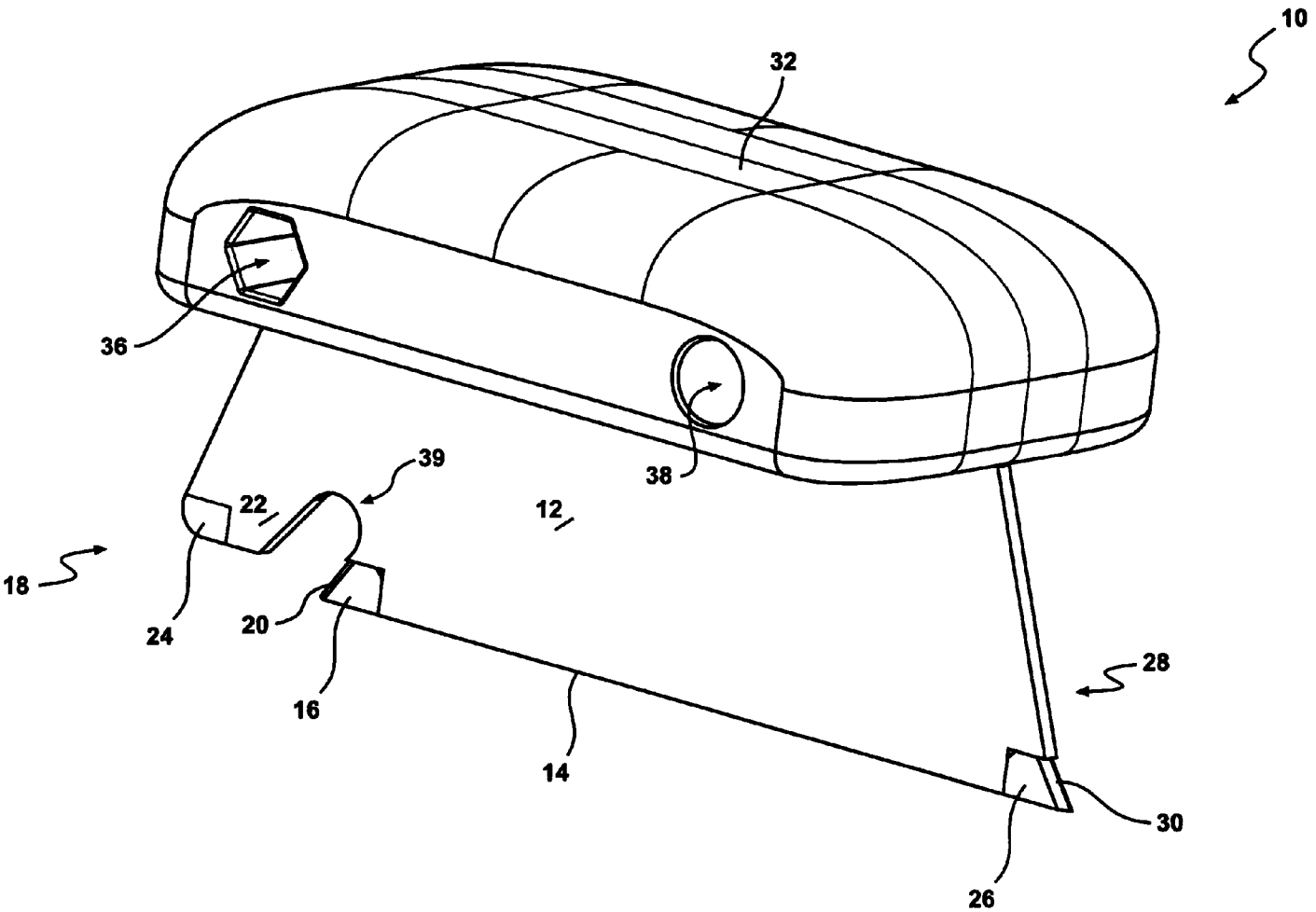
FIG. 1 is a perspective view of a first embodiment of a grout removal and masonry trenching tool.

There are numerous specific details set forth in the following description. However, from the disclosure, it will be apparent to those skilled in the art that modifications and/or substitutions may be made without departing from the scope and spirit of the invention. In some circumstances specific details may have been omitted or enlarged so as not to obscure the invention. Similar reference characters indicate corresponding parts throughout the drawings.

The tool 10 of the present invention has a number of uses. In the first embodiment it may be used as a grout removing device having a cutting tip between 1.0 mm-5.0 mm wide. In a second embodiment the tool 10 may be attached to, or comprise a lightweight electric impact chisel, or may be a hand operated tool. The tool 10 may also be used for heavy-duty use in the process of grooving, trenching or chasing in masonry, brickwork or wall plaster for electrical cable or water pipes etc.

In one embodiment, the tool may be in the style of a hand held chisel when the situation prevents the use of the power driven version of the tool. In this case the tool is used in the same manner as a conventional masonry chisel, the difference being the first and second cutting tips and the depth control.

The cutting tip in the heavy duty application may be between 5 mm-15 mm wide or greater than 15 mm wide. The tool 10 may be attached to an impact hammer drill in chisel mode or similar electric tool may be used.

Figure 2:
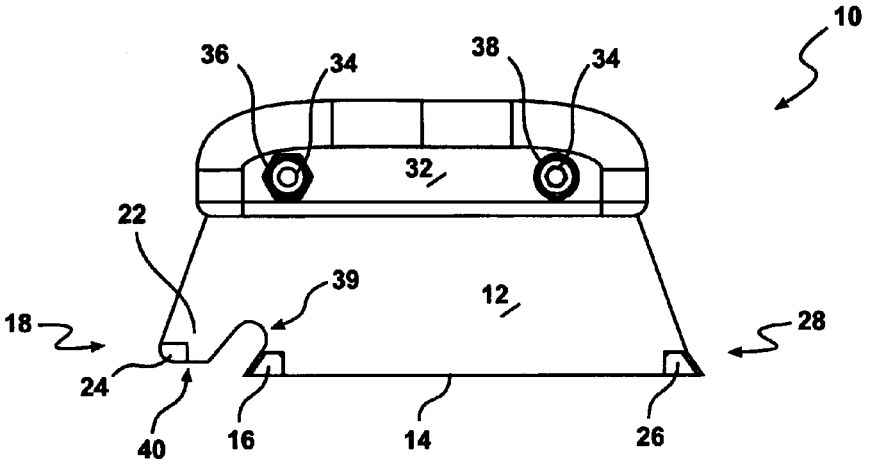
FIG. 2 is a side view of the tool of FIG. 1.
Figure 3:
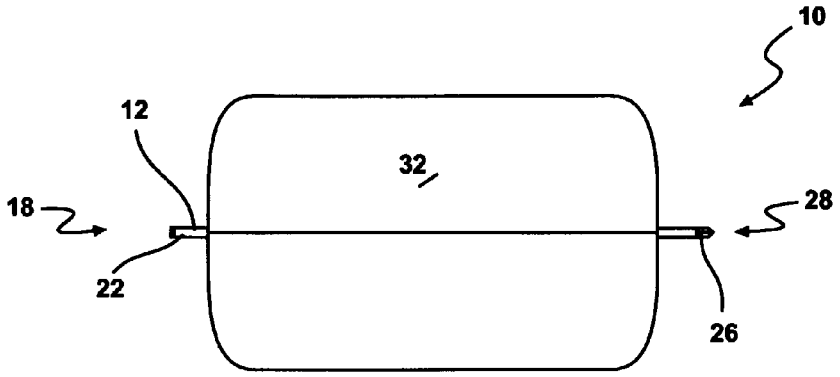
FIG. 3 is a top view of the tool of FIG. 1.

Turning to the figures for a detailed explanation of the invention, there is illustrated a grout removal tool 10 demonstrating by way of examples arrangements in which the principles of the present invention may be employed. As illustrated in FIGS. 1 to 3, the grout removal tool 10 includes, a generally elongate body 12 having a lower portion 14 dimensioned to fit at least partly within a joint between adjacent tiles, a first blade or edge 16 attached to a leading edge 18 of said body 12. The first blade or edge 16 includes a forwardly facing cutting edge 20 for impinging upon and dislodging grout from the joint. A guide 22 is positioned forward of the first blade or edge 16 for controlling the depth to which the first blade or edge 16 penetrates the joint. The guide 22 includes a hardened portion 24 constructed of tungsten carbide.

A second blade or edge 26 is attached to a trailing edge 28 of said body 12 and includes a rearwardly facing cutting edge 30. As the reader will now appreciate the second blade or edge 26 can be used to dislodge grout without being inhibited by the guide 24.

The grout removal tool 10 includes handle 32 that is attached to the body 12 by way of a nut and bolt arrangements 34 that engage apertures 36, 38. The handle 32 is shaped to enable the user to grasp and manually manipulated the tool to remove the grout.

The lower portion 14 of the body 12 is a generally flat longitudinally extending lower horizontal edge for engagement with a longitudinally extending joint.

The body 12 includes an upwardly extending cavity 39 between the first blade or edge 16 and the guide 22. The cavity 39 is located forward of the cutting edge 20 and extends above the blade or edge 16 to provide space into which the dislodged grout can move. The reader will appreciate that as the grout is in the process of being removed it will tend to become raised forward of the cutting edge as further illustrated in FIG. 13. The cavity 39 will therefore accommodate any upward movement of the grout, without operation of the guide 22 being affected.

The guide 22 controls the depth to which the forwardly facing cutting edge 20 penetrates a joint between tiles.

The lower horizontal edge 40 of the guide 22 acts to both direct the first blade or edge 16 to thereby inhibit it from disengaging from within the joint and acts to control the depth to which the first blade or edge penetrates into the joint. The depth to which the first blade or edge 16 penetrates the joint is determined by the distance between the lower horizontal edge 40 of the guide 22 and the lower horizontal edge 14 of the body 12 or the lower tip of cutting edge 20.

Figure 4:
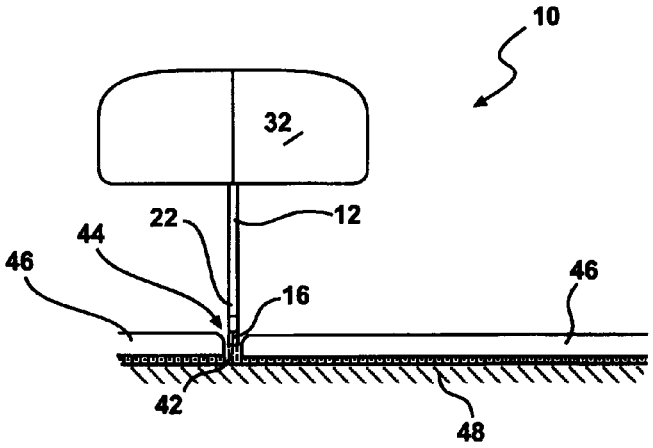
FIG. 4 is a front view of the tool of FIG. 1.

As illustrated in FIG. 4, the blade or edge 16 is configured to impinge upon and remove the grout 42 from within a longitudinally extending joint 44 between adjacent tiles 46. The gauge 22 inhibits the blade or edge 16 from contacting the underlying surface 48. The reader will appreciate that contact with the underlying surface 48 could damage or hasten wear of the blade or edge 16 or affect the integrity of the underlying surface 48.

Figure 5:
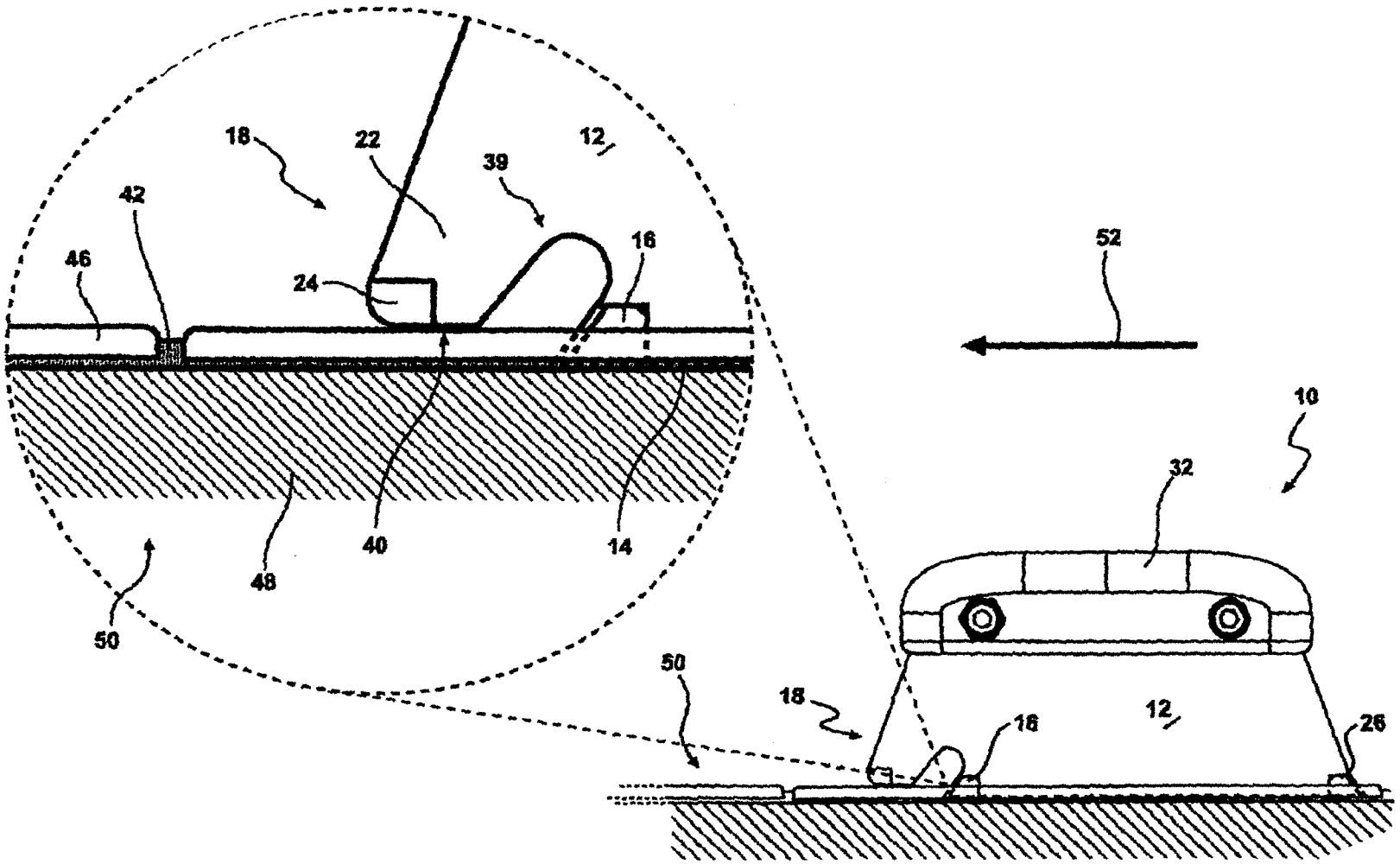
FIG. 5 is a schematic view of the tool of FIG. 1 illustrating the use of the first blade or edge to removal grout from a generally flat area.

As illustrated in FIG. 5 where the tool 10 is being used on a generally flat surface 50 away from obstacle or walls, the user moves the body 12 forwards in the direction of arrow 52 along the longitudinally extending joint 44. The first blade or edge 16 is used to incise and remove the grout 42 from within the joint.

Figure 6:
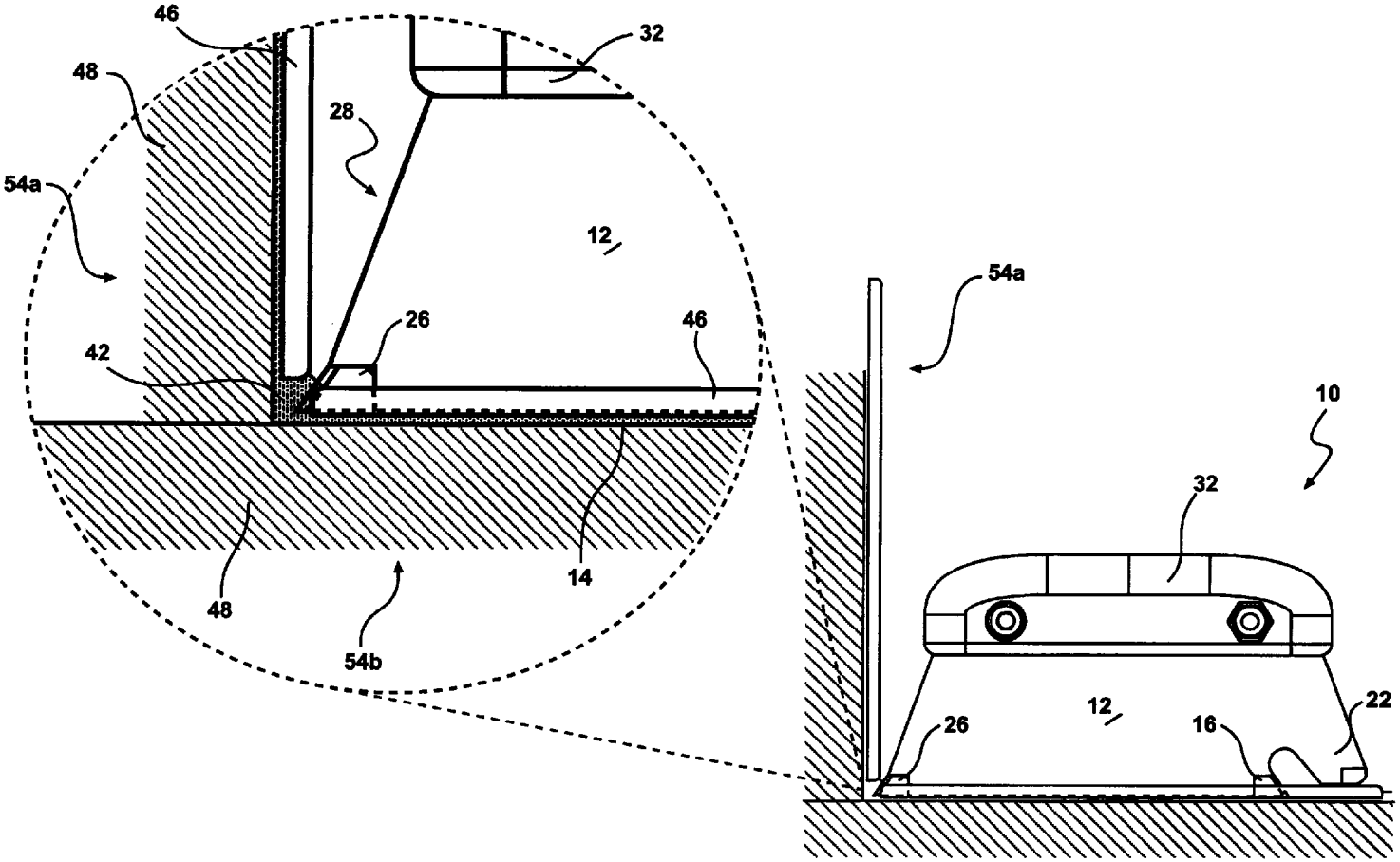
FIG. 6 is a schematic view of the tool of FIG. 1 illustrating use of the second blade or edge to remove grout from a confined area.

When a user wants to remove grout 42 from a confined space or in an area close to the perpendicular junction between two surfaces 54*a*, 54*b*, as illustrated in FIG. 6, the grout removal tool 10 can be reversed so the second blade or edge 26 is pointing forward. In this second orientation the tip of the cutting edge 30 of said second blade or edge 26 projects forward of the body 12 and therefore the user can remove grout 42 from the joint 44 and other areas without being hindered by the guide 22.

Figure 7:
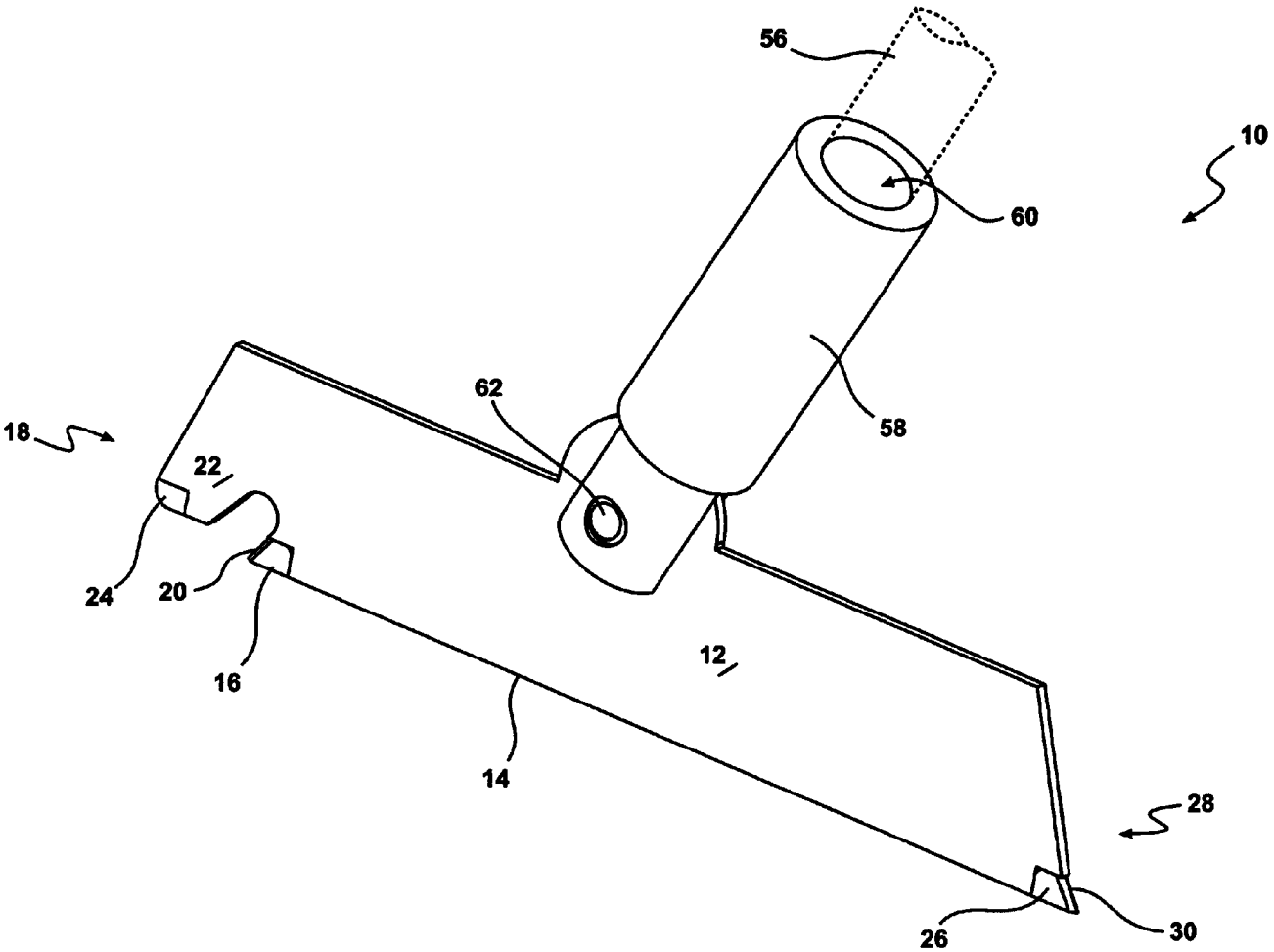
FIG. 7 is a perspective view of a second embodiment of the tool.
Figure 8:
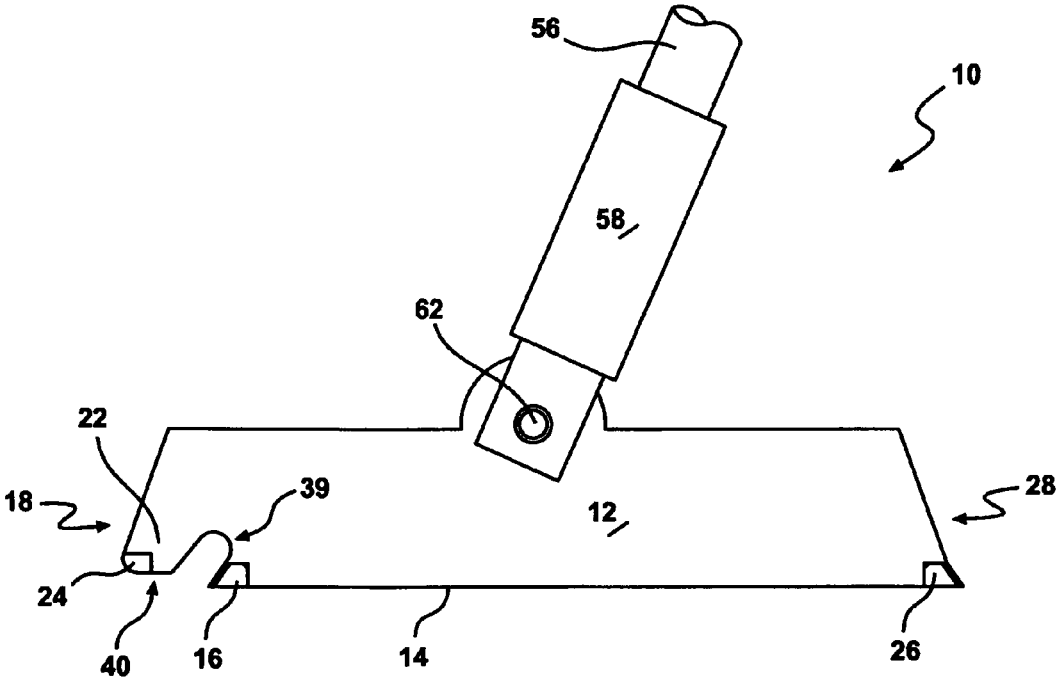
FIG. 8 is a side view of the tool of FIG. 7.
Figure 9:
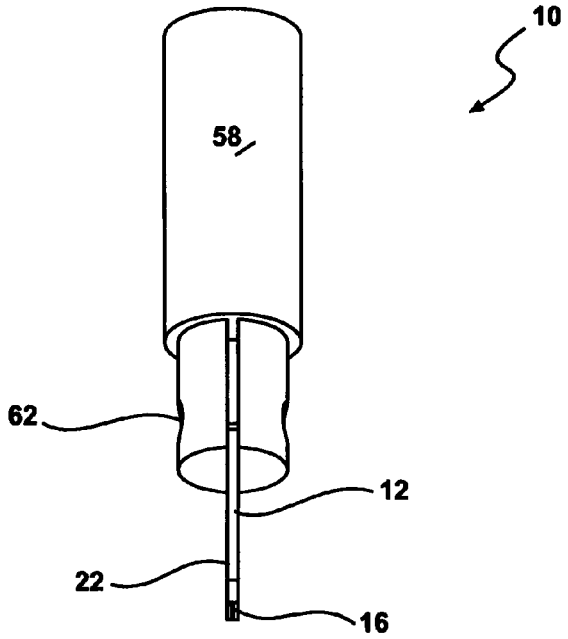
FIG. 9 is a front view of the tool of FIG. 7.

FIGS. 7 to 9 illustrates a second embodiment of the grout removal tool 10 wherein an extension handle 56 may be attached to the body by way of a socket member 58. The socket member 58 may include a threaded aperture 60 for reversible engagement with an end of the extension handle 56. The socket member 58 is attached to the body 12 by way of hinge means 62, whereby in use the handle is configured to extend at an angle rearwardly of the direction of travel. The hinge means 62 may be locked or pivotable to permit the handle to be positioned at various angles and reversed to use the opposite end of the tool in corners. Although not illustrated the extension handle 56 comprising a telescopic member and a handgrip.

Figure 10:
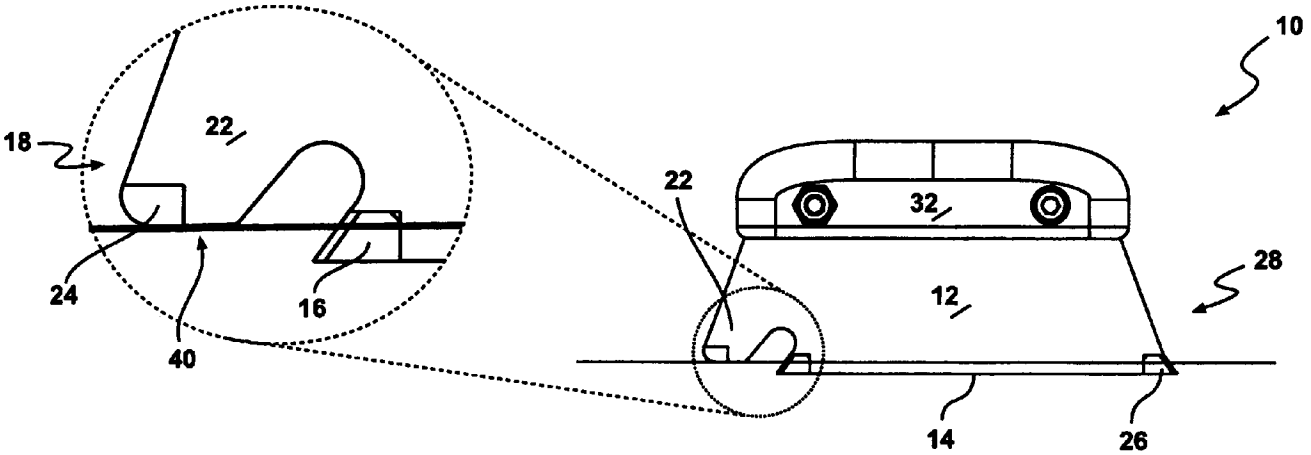
FIG. 10 is a side view of the tool of FIG. 1 illustrating an enlarge portion of the cutting tip.
Figure 11:
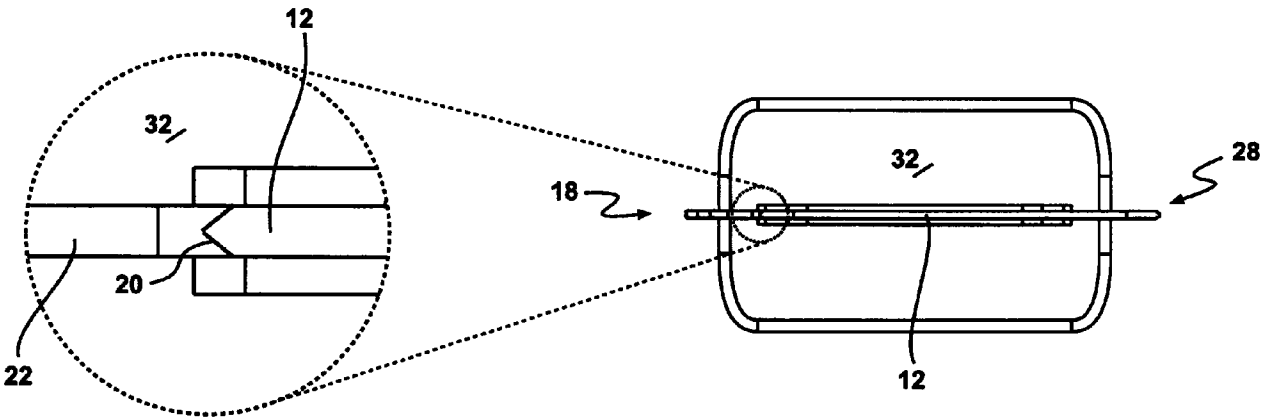
FIG. 11 is an underside view of the tool of FIG. 1 illustrating an enlarge portion of the cutting tip.

As illustrated in FIGS. 10 and 11 the angle of the cutting edge 20 facilitates penetration of the grout. In one embodiment the 45° chamfer of edge 20 moves the debris grout that has been dislodged out of the path of the blade or edge 16. The combination of the two actions acts like a plough to remove the grout. The guide 22 controls the depth and path of the cutting tip. The 45° chamfer of edge 20 also minimises the risk of damage to the tile edges as it passes through an intersection of two grouted joints.

Figure 12:
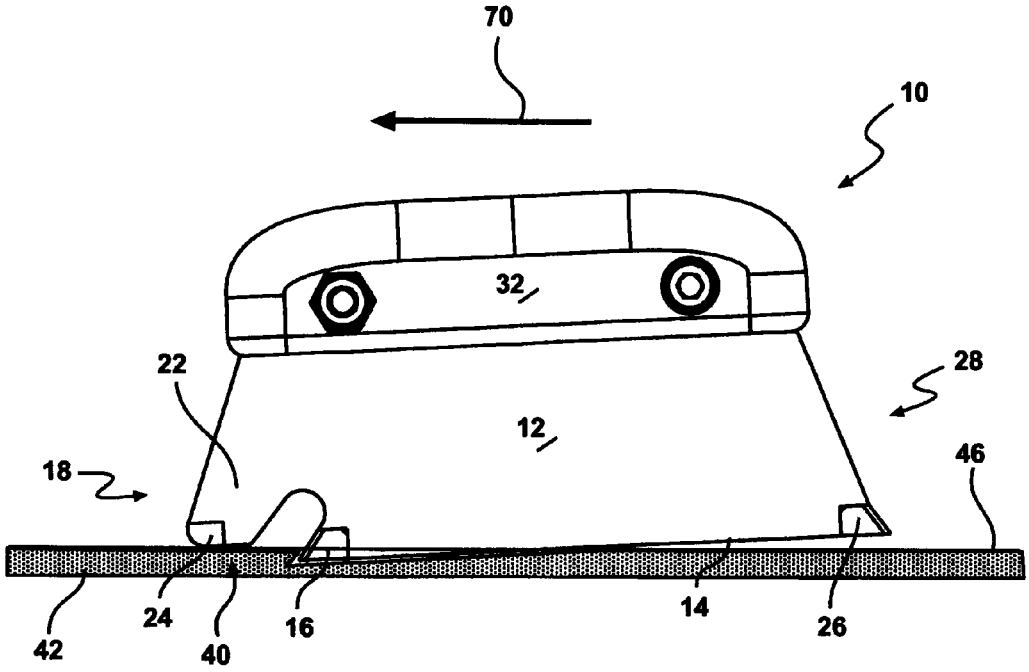
FIG. 12 is a side view of the tool of FIG. 1 penetrating the grout.
Figure 13:
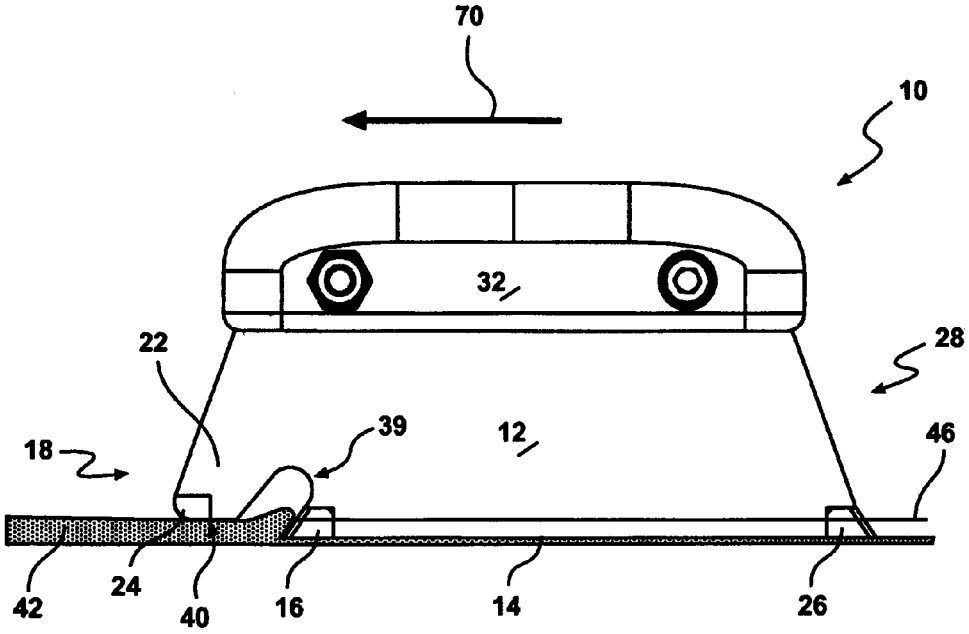
FIG. 13 is a side view of the tool moving along the groove formed by the first blade or edge.
Figure 14:
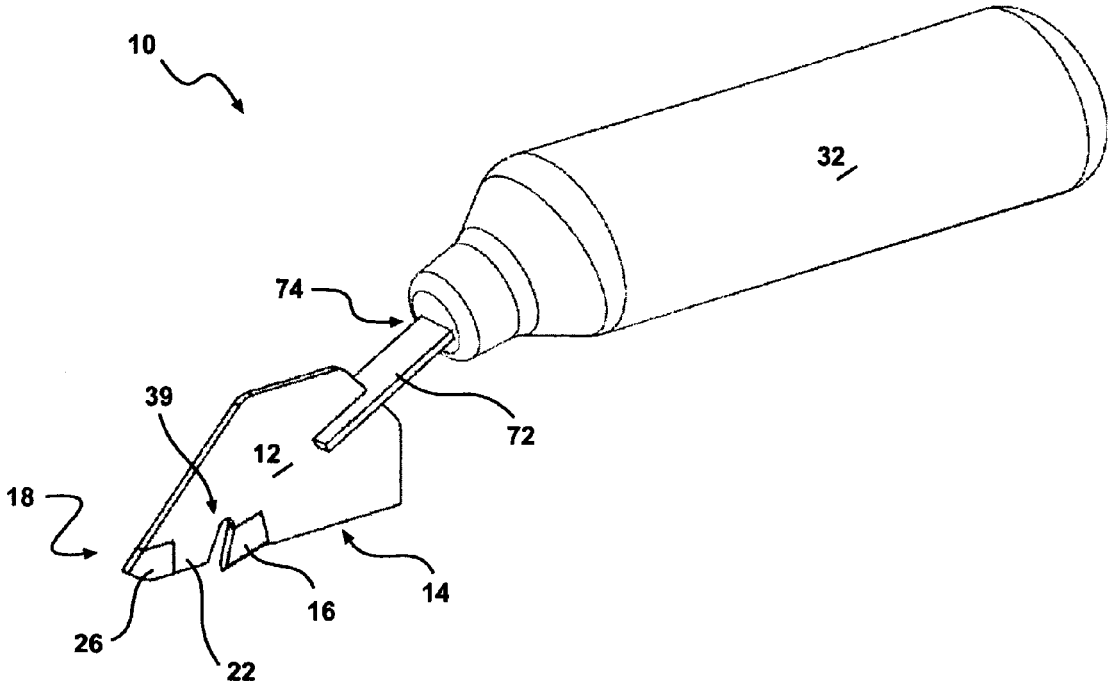
FIG. 14 is a perspective view of a third embodiment of the tool.
Figure 15:
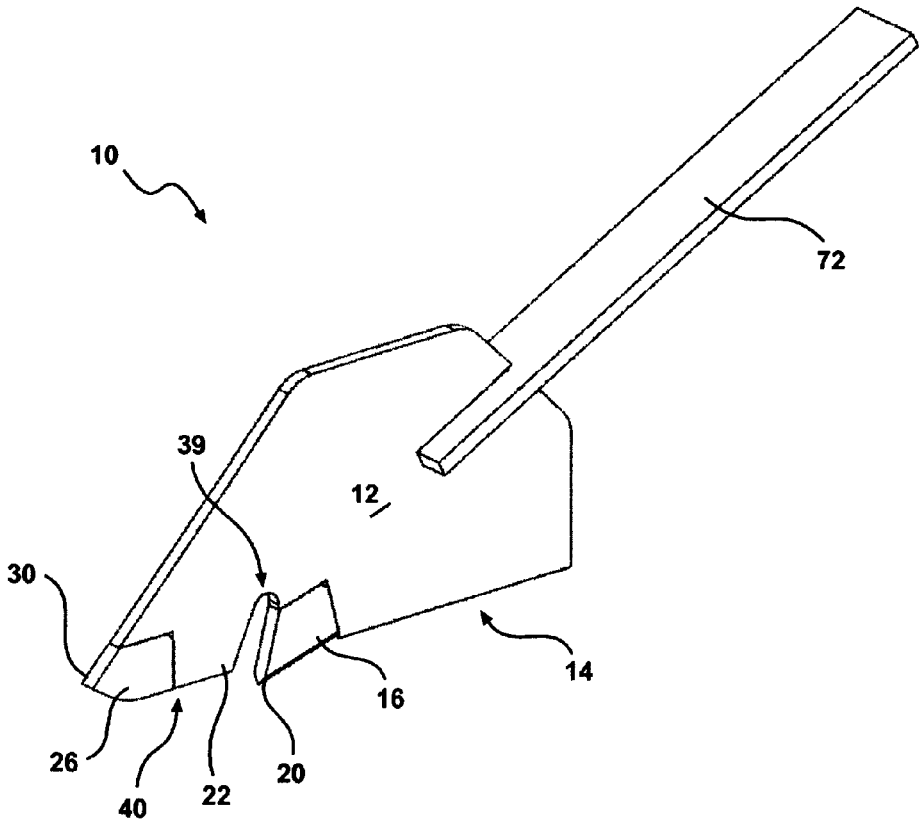
FIG. 15 is a partial view of the tool of FIG. 14 illustrating the tip.
Figure 18:
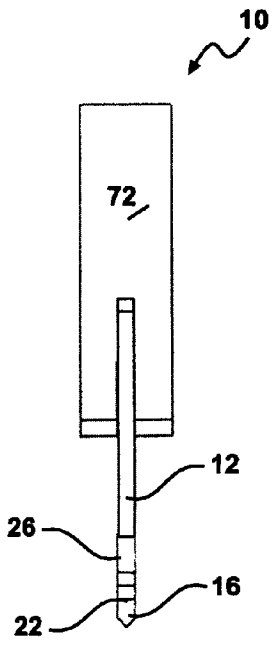
FIG. 18 is a front view of the tip FIG. 15.
Figure 16:
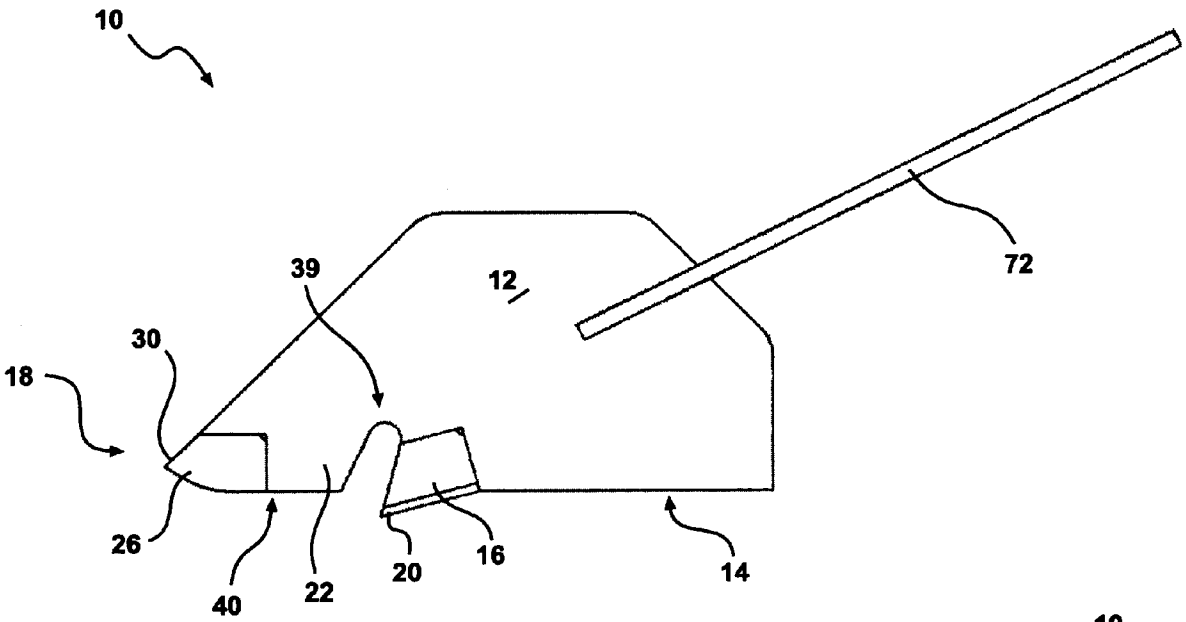
FIG. 16 is a side view of the tip FIG. 15.
Figure 17:
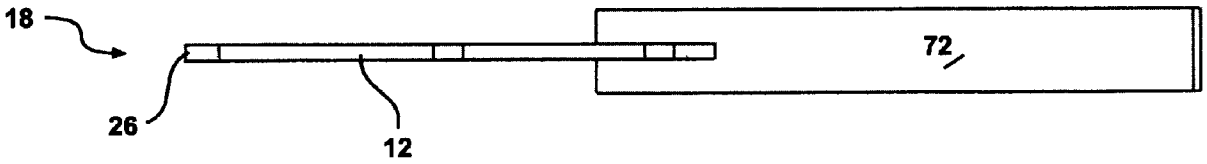
FIG. 17 is a top view of the tip FIG. 15.

As further illustrated in FIG. 12, when commencing the process of grout removal the tool 10 is held at an angle so that the cutting edge 20 of blade or edge 16 gradually penetrates the grout 42 in the direction of travel 70. The trailing end 28 enters the pathway created by blade or edge 16 such that the lower portion 14 is generally parallel to the surface, as illustrated in FIG. 13. The tool 10 remains at a constant depth, which is controlled by guide 22 as it moves in the direction of travel 70. Any upward movement or mounding of the grout 42 forward of the first blade or edge 16, as illustrated in FIG. 13, wilt not inhibit the operation of guide 22 as it will be accommodated within cavity 39.

In another embodiment, as illustrated in FIGS. 14 to 22, the second blade or edge 26 is positioned on the leading edge 18 of the body 12. A projection 72 extends rearwardly of the body for engagement with a mount 74 in the power tool 32.

The tool 10 for dislodging grout from a joint between two adjacent planar surfaces such as tiles, or for removing a strip of material from a masonry surface including, a generally elongate body 12 having a lower portion 14 dimensioned to fit at least partially within a channel created by the first cutting tip 20 of the first blade or edge 16. The first cutting tip 20 forwardly facing for impinging upon and dislodging the material. The guide 22 forward of the first blade or edge 16 for controlling the depth to which the first blade 16 penetrates the grout or the masonry surface. A front portion of the tool being curved upwardly, the front portion including a second blade or edge 26 having a leading secondary cutting tip 30, whereby the rear of the tool 10 may be pivoted upward about the leading edge of the tool to utilise the secondary cutting tip 30 to dislodge the material without being inhibited or obstructed by the guide.

Figure 19:
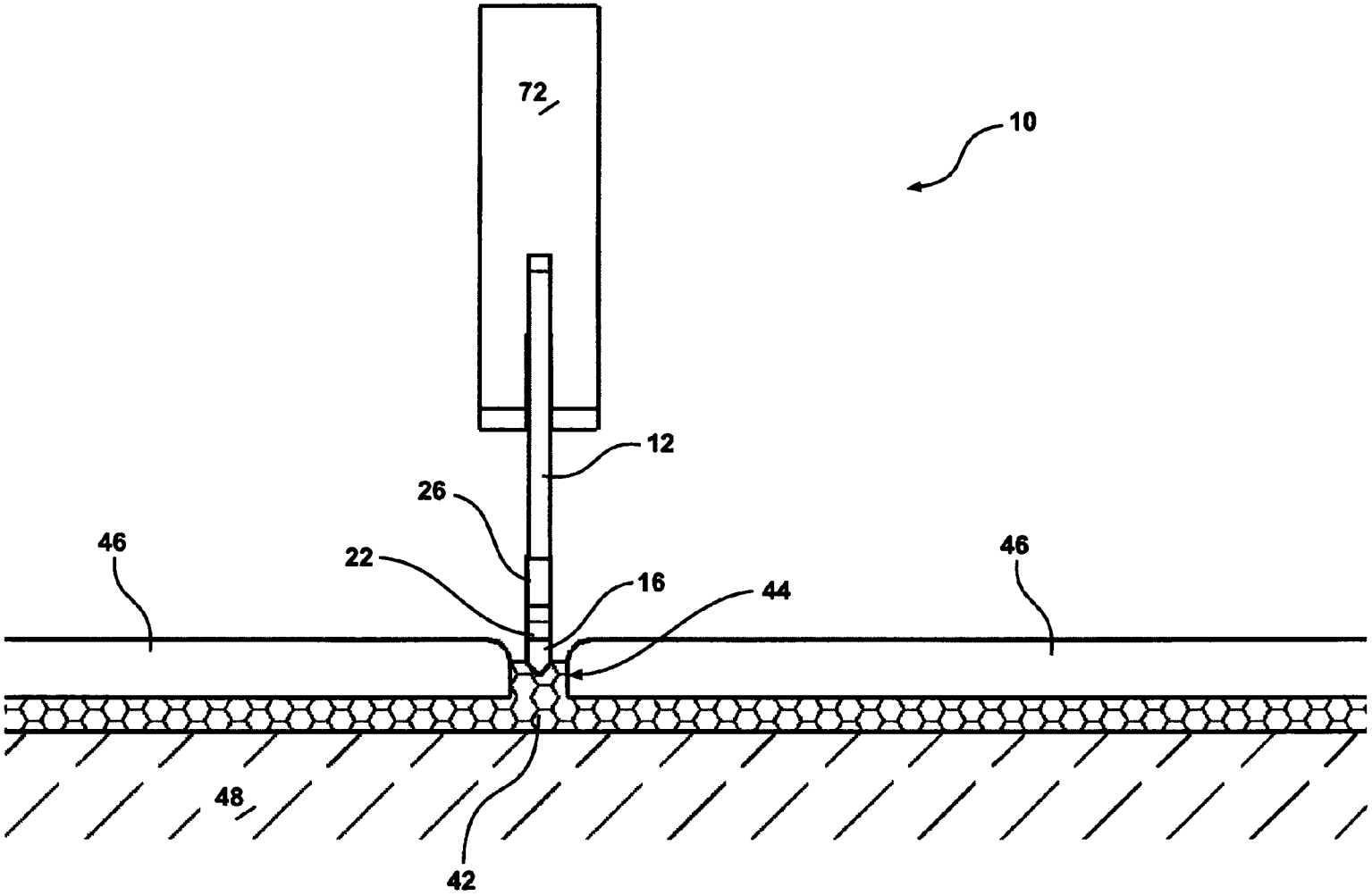
FIG. 19 is a schematic view of the tool of FIG. 14 illustrating the use of the first blade or edge to remove grout from a generally flat area between tiles.
Figure 20:
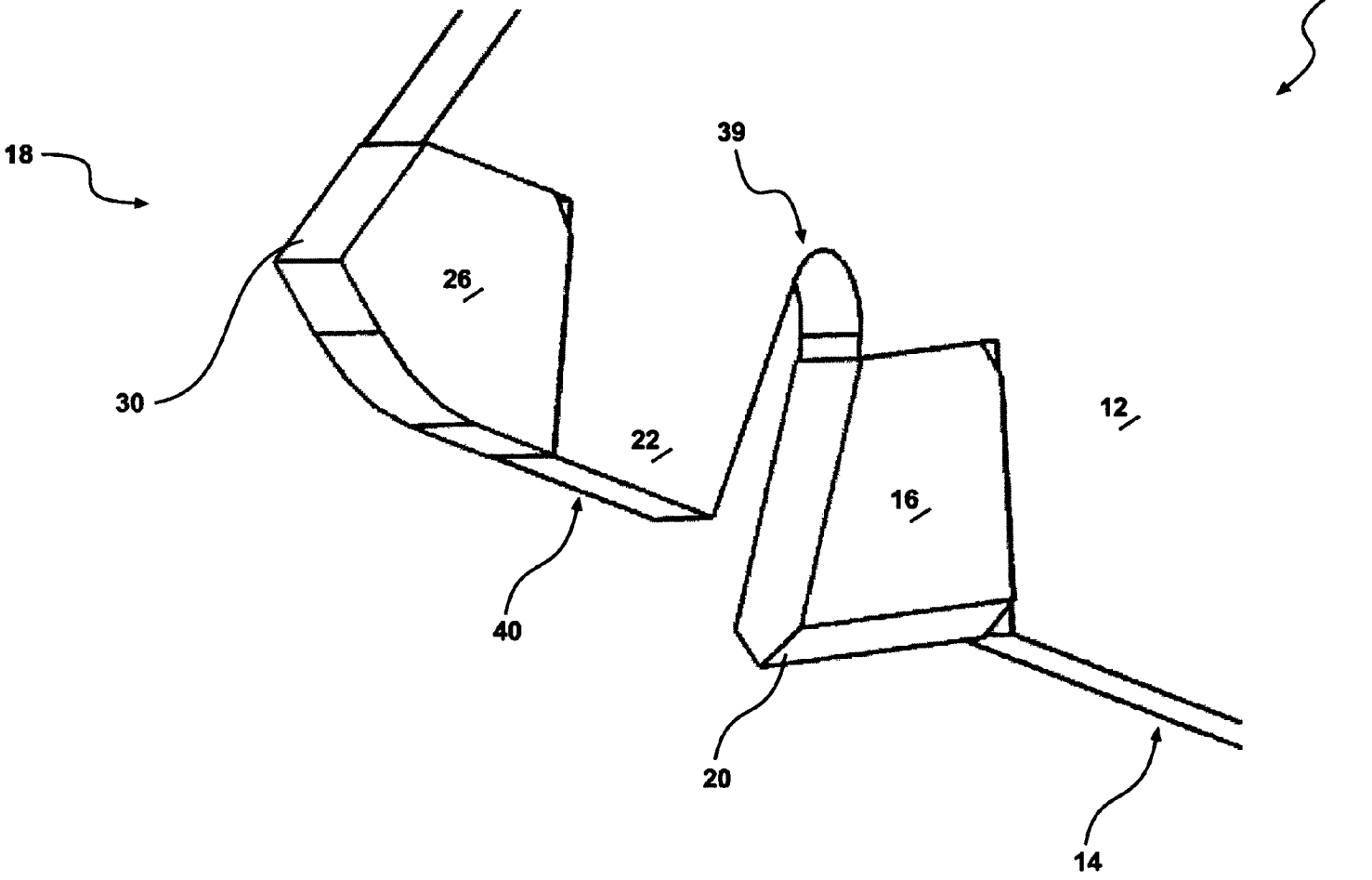
FIG. 20 is a partial view of cutting blades or edges of the tool of FIG. 14.

As illustrated in FIG. 19, the first blade or edge 16 can be used to remove the grout 42 from a joint 44, without being affected by the second blade or edge 26 because the cutting tip 30 is curved upwardly away from the underside 40 of the depth guide 22. As Furthermore, illustrated in FIG. 20, the cutting tip 20 of the first blade or edge 16 extends downwardly below the plane of the underside 14 of the body 12 and the underside 40 of the depth guide 22. In this embodiment the lower edge 20 is chamfered at 45° and the forward facing face of the cutting blade is generally planar.

Figure 21:
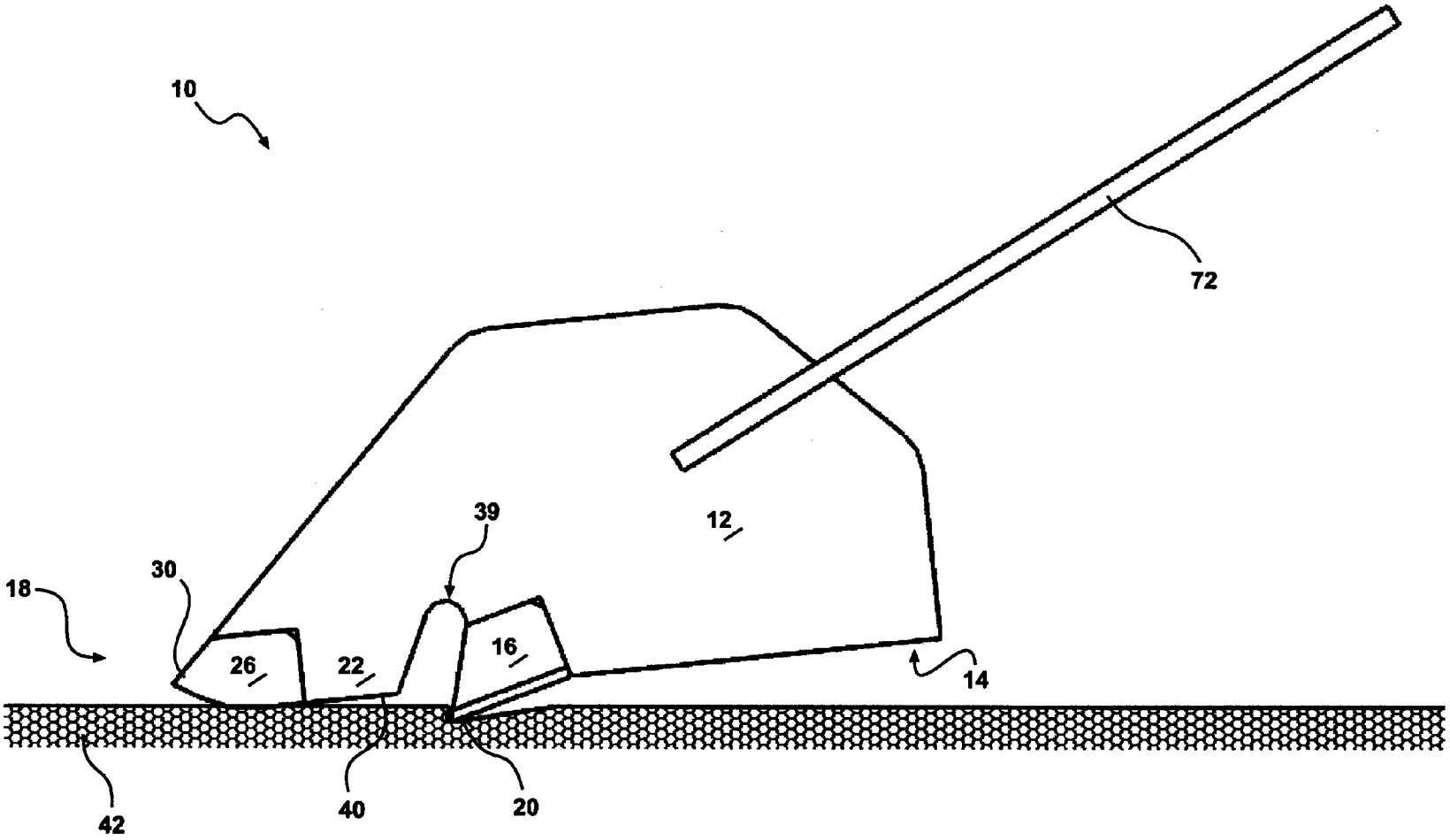
FIG. 21 is a side schematic view of the tool of FIG. 14 illustrating the use of the first blade or edge to remove material from a generally flat surface.

As previously discussed when commencing the process of grout removal the tool 10 is held at an angle so that the cutting edge 20 of blade or edge 16 gradually penetrates the grout 42, as illustrated in FIG. 21. As can be seen in this orientation the second cutting tip 30 is still held clear of the grout 42.

Figure 22:
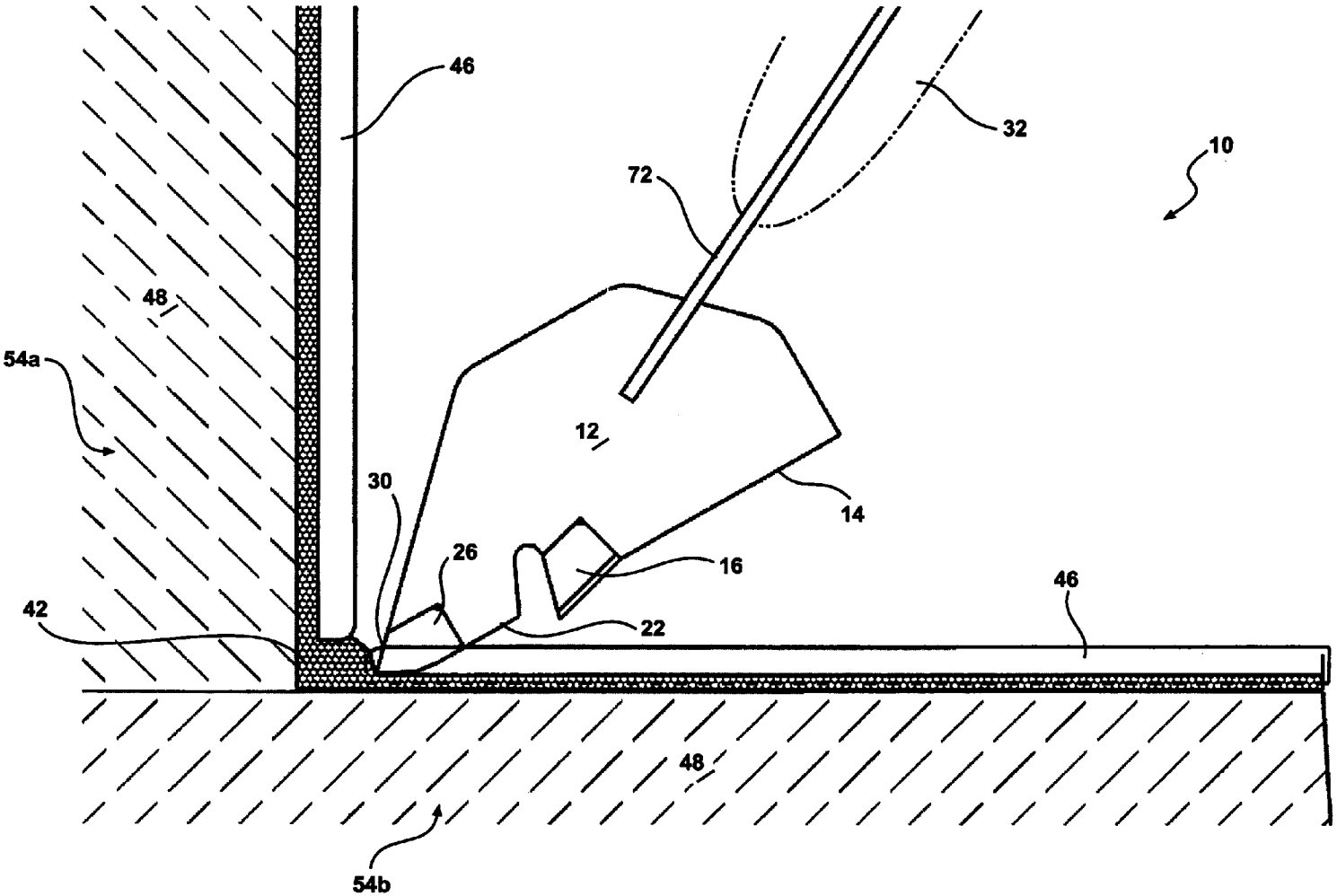
FIG. 22 is a schematic view of the tool of FIG. 14 illustrating use of the second blade or edge to remove grout from a confined area.

When a user wants to remove grout 42 from a confined space or in areas close to the perpendicular junction between two surfaces 54*a*, 54*b*, as illustrated in FIG. 22, the tool 10 can be pivoted so the secondary cutting tip 30 of the second blade or edge 26 can be used without being obstructed by the depth guide 22.

Figure 23:
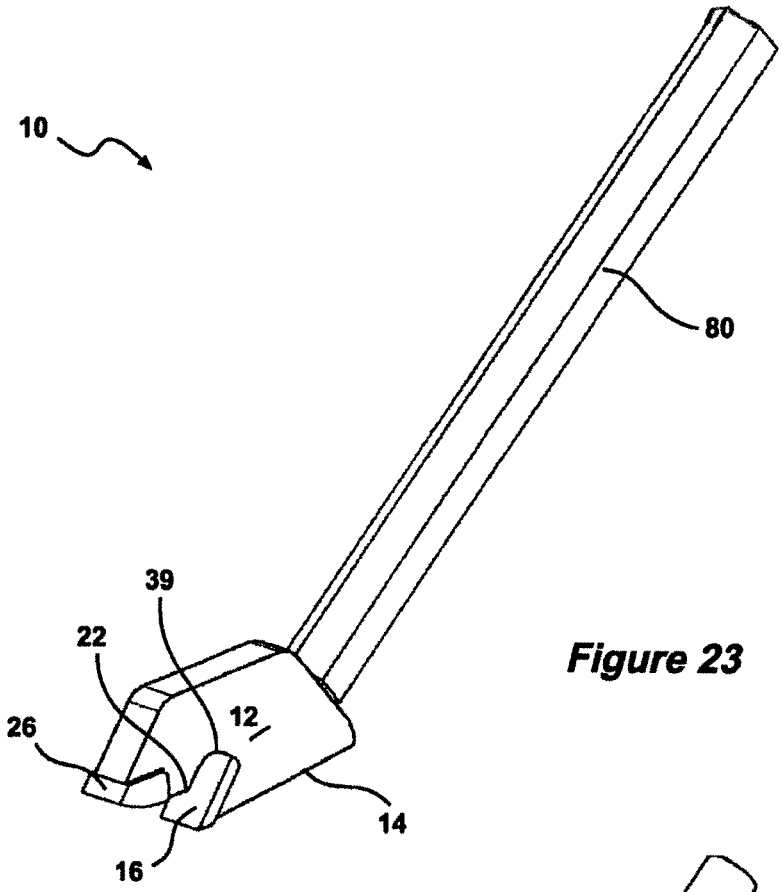
FIG. 23 is a perspective view of one embodiment of the tool in the form of a chisel.
Figure 24:
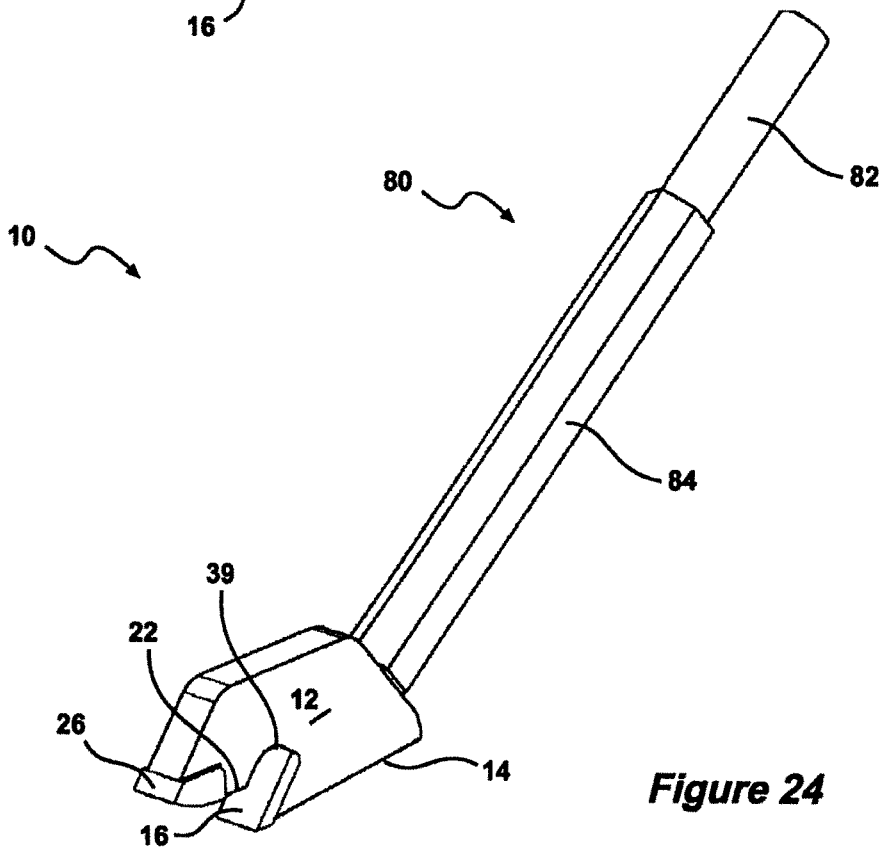
FIG. 24 is a perspective view of another embodiment of the tool in the form of a chisel.
Figure 25:
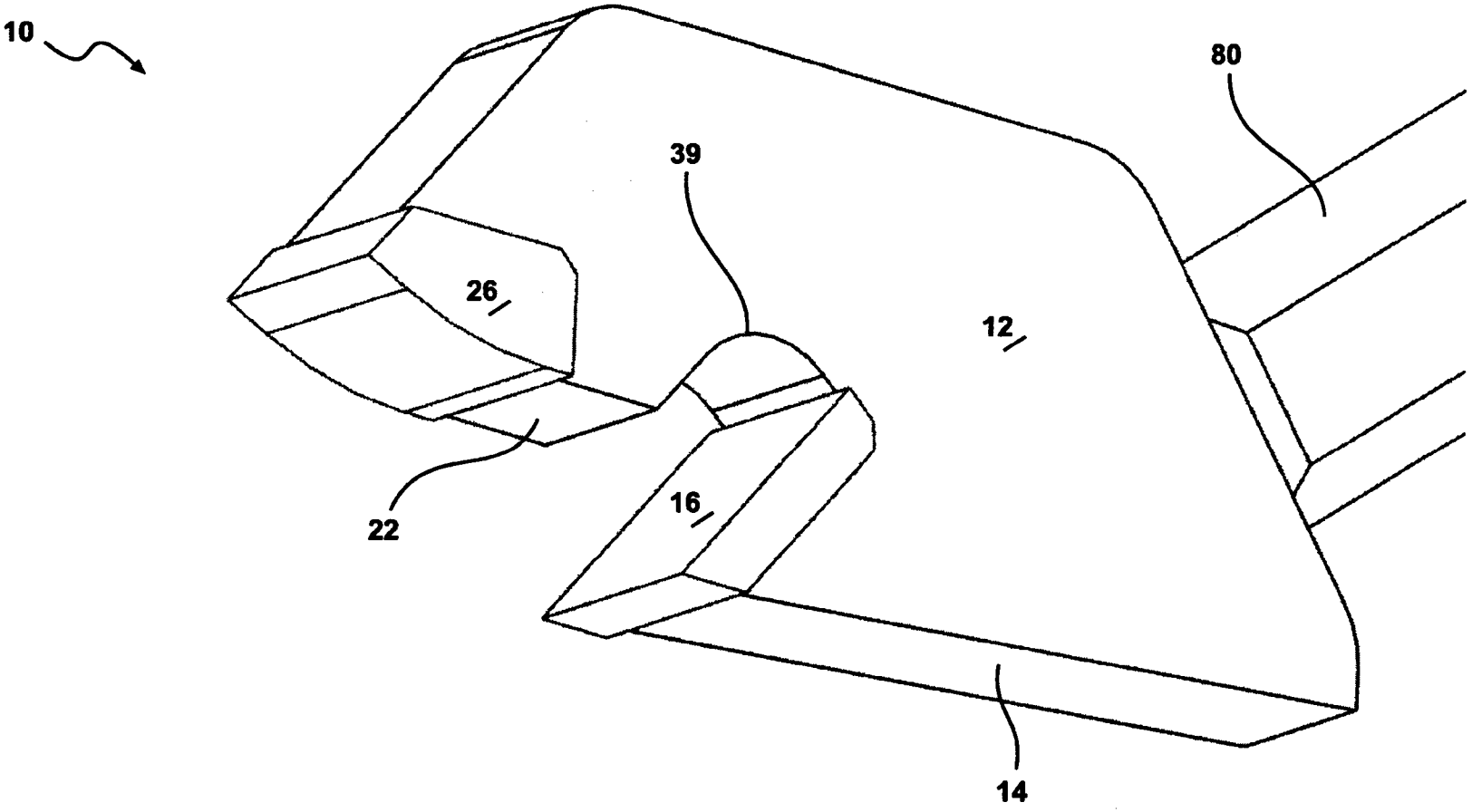
FIG. 25 is an underside perspective view of the chisel of FIG. 23.
Figure 26:
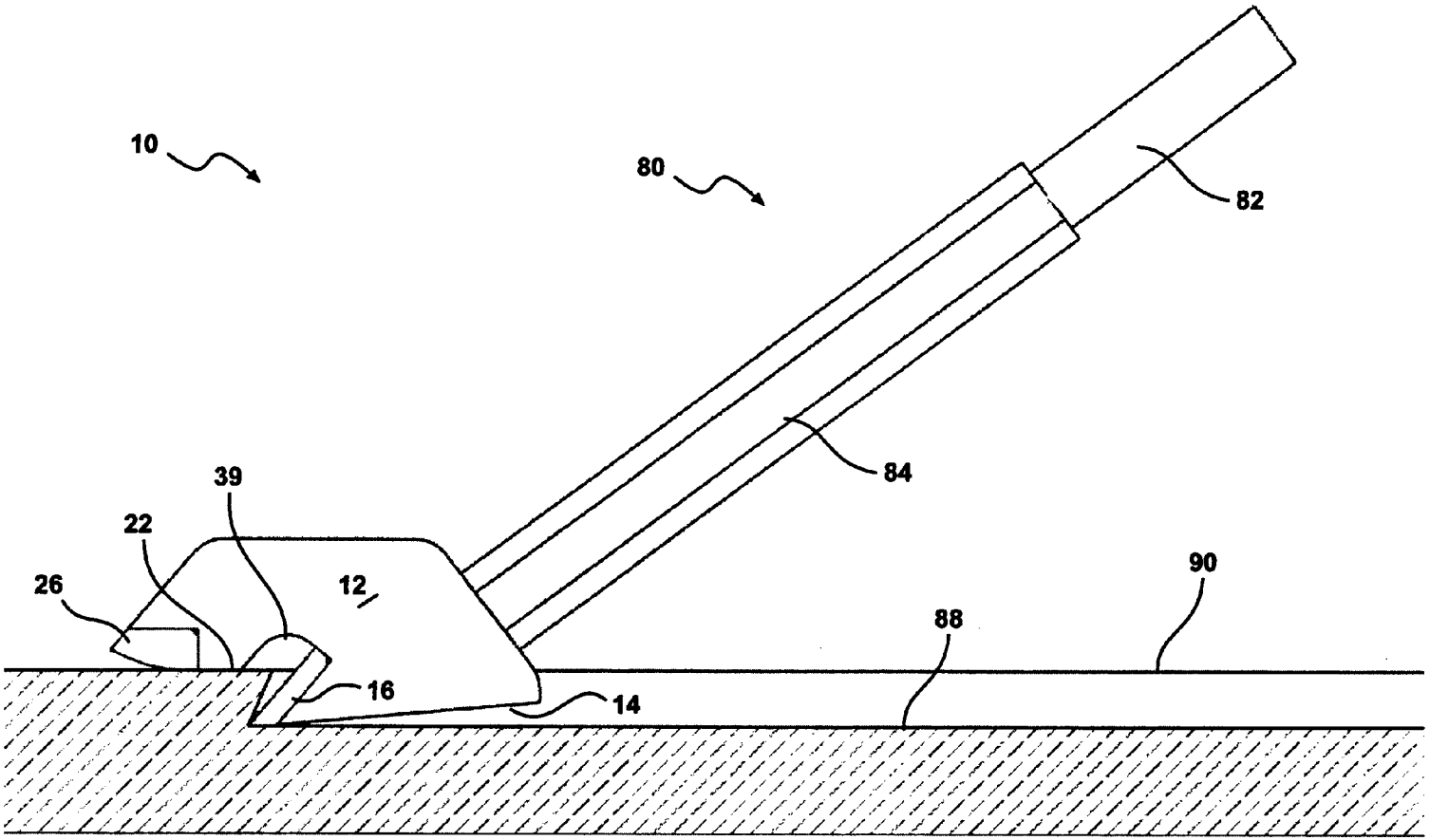
FIG. 26 is a side view of the chisel of FIG. 24 in use.

In another embodiment of the tool 10, as illustrated in FIGS. 23 and 26, there is illustrated a chisel wherein the body 12 is attached to a regular chisel handle 80 as illustrated in FIG. 23 or a chisel handle 80 including portions 82 and 84 for connection to a power tool, as illustrated in FIG. 24.

As the reader would appreciate the tool 10 may be attached to, or comprise a lightweight or heavy-duty electric impact chisel, or may be a hand operated chisel. In this embodiment the tool can be used in the process of grooving, trenching or chasing in masonry, brickwork or wall plaster for electrical cable or water pipes. As illustrated in FIG. 26 the tool 10 is used in a similar fashion as describe about to create a groove or trench 88 in surface 90.

As the skilled addressee will now appreciate the illustrated invention provides a grout removal tool, masonry trenching tool that provides a first blade or edge that can be used to remove material from a joint where the surface is generally flat, wherein the guide is positioned forward of the first blade or edge for controlling the depth to which the blade or edge penetrates the joint. The tool can also be pivoted so that the second blade or edge can be used where there are obstacles or where there is a junction between surfaces wherein the second blade or edge is uninhibited by the guide.

Various features of the invention have been particularly shown and described in connection with the exemplified embodiments of the invention, however, it must be understood that these particular arrangements merely illustrate and that the invention is not limited thereto. Accordingly the invention can include various modifications, which fall within the spirit and scope of the invention. It should be further understood that for the purpose of the specification the word "comprise" or "comprising" means "including but not limited to".

The claims defining the invention are as follows:

1. A tool for dislodging grout from a joint between two adjacent planar surfaces, or for removing a strip of masonry material from a masonry surface, the tool comprising:

a planar body including a leading edge and a straight lower edge, a first incising member positioned forward of the lower edge, a depth guide for the first incising member positioned forward of the same, the depth guide having a straight guide edge, a cavity comprising an entrance located between the first incising member and the depth guide, and extending from the entrance upwardly into the planar body to provide a space into which the dislodged grout or masonry material can move, the cavity further comprising a pair of opposing sides, where one of these sides comprises a rearwardly inclined leading edge of the first incising member, the lower edge of the planar body having a width not greater than a width of the first incising member and a second incising member located at the leading edge and positioned forward of and above the depth guide.

2. The tool of claim 1, wherein the body is curved upwardly and convexly as it extends forwardly from the guide edge.

3. The tool of claim 1, wherein an underside of the first incising member rearward of a first cutting tip thereof is relieved at an angle upward.

4. The tool of claim 1, wherein the lower edge is adapted for engagement with a longitudinal portion of the joint or channel formed by the first incising member.

5. The tool of claim 1, wherein a lower horizontal portion of the depth guide acts to direct the first incising member to inhibit it from disengaging from within the joint.

6. The tool of claim 5, wherein the depth to which the first incising member penetrates the joint or planar surface is determined by a distance between the guide edge of the depth guide and a lowermost tip of the first incising member.

7. The tool of claim 1, wherein the guide edge of the depth guide is parallel with the lower edge of the body.

8. The tool of claim 1, wherein the guide edge of the depth guide is collinear with the lower edge of the bodywherein a leading edge of the depth guide includes a hardened portion which is either of removable from or integral with the depth guide.

9. The tool of claim 1, wherein the first incising member and the second incising member are integral with the body, such that when the incising members are worn the tool is discarded.

10. The tool of claim 1 wherein the first incising member and the second incising member are removably attached to the body such that the incising members can be replaced when they are worn or damaged.

11. The tool of claim 1, wherein the first incising member and the second incising member are hardened.

12. The tool of claim 1, wherein the tool is mounted to, or comprises part of, a powered hand tool including a reciprocating power tool.

13. The tool of claim 1, wherein the tool comprises a handle.

14. A method of removing grout from a joint between tiles or material from a masonry surface using a tool including:

a planar body including a leading edge, and a straight lower edge, a first incising member positioned forward of the lower edge, a depth guide for the first incising member positioned forward of the same, the depth guide having a straight guide edge, a cavity comprising an entrance located between the first incising member and the depth guide, and extending from the entrance upwardly into the planar body and above the first incising member to provide a space into which the dislodged group or masonry material can move, the cavity further comprising a pair of opposing sides, where one of these sides comprises a rearwardly inclined leading edge of the first incising member, the lower edge of the planar body having a width not greather than a widge of the first incising member, the method comprising the steps of positioning the tool against a joint between at least two adjacent tiles, or on a masonry surface, such that the planar body is positioned about perpendicular to the at least two adjacent tiles or the masonry surface, and applying a force so that the first incising member impinges upon and dislodges said grout from within the joint or material from said masonry surface, and wherein the depth guide controls the depth to which said first incising member penetrates.

15. The method of claim 14, the method comprising the further step of pivoting, rotating or otherwise moving the tool to access the second incising member to dislodge said grout or said material uninhibited by said depth guide.

* * * * *